US005850651A

United States Patent [19]

Ishimaru et al.

[11] Patent Number: 5,850,651

[45] Date of Patent: Dec. 22, 1998

[54] AIR JET FLOW TYPE APPARATUS AND METHOD FOR TREATING TEXTILE MATERIAL

[75] Inventors: Osamu Ishimaru, Habikino; Masao Takigawa, Toyonaka; Satoshi Nomura, Itami, all of Japan

[73] Assignee: Hisaka Works, Ltd, Osaka, Japan

[21] Appl. No.: 822,089

[22] Filed: Mar. 20, 1997

[30] Foreign Application Priority Data

Jul. 21, 1995 [JP] Japan ..... 7-185331
Aug. 28, 1995 [JP] Japan ..... 7-218434

[51] Int. Cl.[6] ..... D06B 3/28

[52] U.S. Cl. ..... 8/152; 68/177

[58] Field of Search ..... 8/152; 68/177, 68/178; 26/20, 21, 87, 105, DIG. 1

[56] References Cited

U.S. PATENT DOCUMENTS

| | | |
|---|---|---|
| 3,949,575 | 4/1976 | Turner et al. . |
| 4,392,365 | 7/1983 | Miyamoto et al. . |
| 4,483,032 | 11/1984 | Christ et al. . |
| 4,578,085 | 3/1986 | Ishimaru . |
| 4,716,744 | 1/1988 | Turner et al. . |
| 4,825,491 | 5/1989 | Miyamoto et al. . |

FOREIGN PATENT DOCUMENTS

| | | |
|---|---|---|
| 51-32885 | 3/1976 | Japan . |
| 63-36385 | 7/1988 | Japan . |
| 730505 | 4/1994 | Japan . |
| 753943 | 6/1995 | Japan . |
| 7185331 | 7/1995 | Japan . |
| 7-218434 | 8/1995 | Japan . |
| 7218434 | 8/1995 | Japan . |
| 7-27281 | 9/1995 | Japan . |
| 7268763 | 10/1995 | Japan . |
| 7305261 | 11/1995 | Japan . |
| 8296166 | 11/1996 | Japan . |
| 9601985 | 7/1996 | WIPO . |
| PCT/JP96/01985 | 7/1996 | WIPO . |

OTHER PUBLICATIONS

"Treating Technology for Textile/Dyeing/Finishing", Takigawa et al., Kako Gijutu, Jul. 10, 1996, vol. 31, No. 7, pp. 428–433, 484.

Takigawa Masao, Kako Gijutu, "Low Ratio Dyeing Method and Special Treating", Jul. 1996, pp. 12–17 & 68.

*Primary Examiner*—Frankie L. Stinson
*Attorney, Agent, or Firm*—Pillsbury Madison & Sutro LLP

[57] ABSTRACT

A treating apparatus and method of the present invention carry out dyeing, scouring, bleaching and other treatment for feeling of a textile fabric by transferring and circulating the textile fabric with jetting force of air and liquor using an air jet flow type apparatus which is equipped with a fabric treating passageway in circular form comprised of a transferring passageway and a residence chamber both ends of which are jointed to one another, and perform a series of treating operations such as charging fabric, raising and holding of temperature at a constant degree, cooling and drying more efficiently in a short time. The exit section of the residence chamber is located at a position lower than the entrance section of the chamber, close to the ground on which the apparatus is installed, whereby charge and take-out of a textile fabric is facilitated. Since the treating fluid jetting section is provided at the inlet portion of the transferring passageway (the exit section of the residence chamber), the textile fabric under circulating is almost free from tension load, rope wrinkle, friction mark, contact mark, etc.

16 Claims, 6 Drawing Sheets

AIR JET FLOW TYPE APPARATUS AND METHOD FOR TREATING TEXTILE MATERIAL

TECHNICAL FIELD

The invention relates to an air jet flow type apparatus and method for treating textile materials (fabrics) in rope form, wherein dyeing, scouring, bleaching, and feeling-treatment of textile materials are performed by wet treatment while transferring and circulating the materials through a circular fabric treating passageway by means of jet flow of air and liquor.

BACKGROUND ART

Air jet flow type apparatus for treating textile material is well known, wherein the textile material is treated by transferring and circulating the said material with air jet flow and wetting the said material with a treating liquid. For example, such prior art is disclosed in U.S. Ser. No. 74 489403 (Japanese Laid-open Patent Specification (Kokai) No. 51-32885), DE P3142200.4 (Japanese Patent Publication No. 63-36385), etc.

The apparatus disclosed in these prior arts enables treatment of textile material at extreme low liquor ratio (1:3 or less) by transferring and treating textile material, etc. with air jet flow and is more excellent due to the said treatment method than conventional liquor flow type dyeing machine wherein textile material is transferred and dyed with jet flow of liquor, but the apparatus has difficulties as mentioned below in practical treatment of textile material.

In more detail, the invention disclosed in the former patent specification No. 51-32885 relates to the method for treating textile material in two process steps, wherein treating liquor of normal temperature is applied to textile material through inert gas (usually air) and subsequently steam is fed into a residence chamber for changing the temperatures of surface of the textile fabric and treating liquor, whereby dyestuff is penetrated in and fixed to the textile fabric, but the disadvantage of this method is to need a long time for the treatment.

On the other hand, the invention disclosed in the latter patent publication No. 63-36385 relates to the method for circulating and treating textile material for a given time, wherein circulation of the textile material is started with jet flow of non-inert gas (hot air or steam) and subsequently the said textile material is rapidly heated up to a preset temperature using steam which is fed from a steam feed pipe.

However, as a disadvantage of the said method, where steam is used as air jet flow to transfer textile fabric, the steam results in dew condensation on the inner wall of tank and the dew condensate drops onto textile fabric to be treated, then resulting in uneven dyeing of the textile fabric in spot form, and simultaneously steam condensation causes the volume of treating liquor to increase and, as a result, the concentration of treating liquid to fluctuate due to the increased liquor.

Furthermore, in both of the former and latter inventions, a header having a driving reel is provided in projection form on the round section of the apparatus so as to allow smooth transfer of textile fabric with large head drop, but this head drop causes tension to act on the textile fabric when it is took up, and then results in rope wrinkle and force wrinkle on the textile fabric due to fabric lap phenomenon, in addition, causes failure to achieve sufficient relaxing effect for the textile fabric.

As an apparatus to eliminate a part of the difficulties mentioned above, Japanese Patent Publication (Patent publication No. 7-30505, Patent Application No. 4-226024) proposes a new air jet flow type apparatus for treating textile material in rope form (See, for reference, FIG. 8 and FIG. 9). More particularly, as a whole the apparatus comprises fabric transferring tube 42 and residence chamber 43 which are configured in longitudinal direction wherein the inlet portion of the transferring tube and the outlet portion of the residence chamber are jointed to one another through a header 44 and the outlet portion of the said transferring tube is jointed in insertion to the entrance of the residence chamber, thus a fabric treating passageway 45 is formed in circular form. Therefore, this fabric treating passageway 45 comprises the header 44 having driving reel 46 which is built in the header, treating fluid jetting section 47 which is connected to the said header in horizontal position, the transferring tube 42 which extends in horizontal direction from the treating fluid jetting section, and the residence chamber 43 wherein the inlet section thereof connected to the outlet portion of the said transferring tube acts as a means for dropping down fabric which is in downward slope, the intermediate section of the chamber is a little sloped toward the fabric advancing direction, and rising part 48 wherein the outlet portion thereof is acutely bent upward so as to permit jointing the rising part to the header.

The apparatus transfers and circulates textile fabric, etc. through a circular fabric treating passageway with air jet flow, exactly controls the temperatures of air and liquor by heat exchangers 51, 52 which are installed on each of air circulation conduit 49 and treating liquor circulation conduit 50, and produces air-liquor mixed fluid from the temperature-controlled air and liquor by fluid mixing portion 53 and dyes textile fabric by spraying the air-liquor mixed fluid into the textile fabric, whereby extreme low liquor ratio ( liquor ratio 1:3 or less ) is achieved.

In the art disclosed in the Patent Publication No. 7-30505, however, since the exit section of the residence chamber which bends at acute angle in upward direction is jointed with the header, the head drop from the bottom of the chamber to the header is so great that tension load acts on textile fabric, then resulting in rope wrinkle and force wrinkle of fabric in the residence chamber. Moreover, since fabric is fed into a transferring passageway which extends in nearly horizontal direction after converting the fabric to the angle ranging from 120 to 150 degrees from vertical position by the reel or roll which is built in the header, fabric friction and contact with the reel or roll take place in the fabric, then resulting in risk of fabric damage which is not allowed in the view of fabric quality. Further, when fabric jetting force jetted from the treating fluid jetting section and driving force by the reel or roll are concurrently applied to the fabric, different propelling force between the fluid and the reel or roll makes it difficult to keep the fabric transfer speed at uniform rate. An example wherein the reel or roll is omitted is proposed in Patent Application No. 6-051591 (Patent Publication No.7-268763)

In addition, the air jet flow type apparatus of conventional example mentioned above pre-produce mixed fluid of air and liquor by a fluid mixing portion (See, for reference, FIG. 9) and feeds and dyes textile fabric by spraying the mixed fluid onto the textile fabric from the treating fluid jetting section.

Since, thus, the treating liquor is mixed and atomized into air flow by the fluid mixing portion, it is impossible to achieve the mixed fluid of proper ratio according to the weight per specific unit (METSUKE) of the fabric to be treated and, therefore, the kind of fabric which can be treated by the said apparatus is limited. Further, an example of treating fluid jetting section having an air jetting portion and a liquor jetting portion is proposed in Patent Application No. 6-27079, but the treating fluid jetting section is of fixed type so that it is impossible to change individually the air spray pressure and liquor spray pressure.

Moreover, in the conventional air jet flow type apparatus, dyed textile fabric is cooled down to, at least, approximately 80 degrees C. while being circulatingly transferred, after completion of dyeing treatment, and thereafter the treating liquor accumulated at the bottom of the residence chamber is drew off. But during the above cooling process, since the air and liquor mixed fluid which is cooled down using cooling water is further sprayed continually from the fluid jetting section, the required cooling time tends to extend, due to the water cooling system which is indispensable and cools down the fluid indirectly by heat exchanger. In addition, when the treating fluid temperature has lowered to some extent, oligomer which is eluted from treated fabric tends to re-adhere to the treated fabric and also the heat value of the treated fabric is retained at comparatively high degree due to the treating liquor which is sprayed on the fabric even during cooling operation. This high heat value of the treated fabric and indirect cooling system using cooling water makes the required cooling time longer.

Ishimaru, one of the inventors of the present invention, has proposed a method of using gasified latent heat without using cooling water as an invention which eliminates the above-mentioned problems (Japanese Patent Application No.7-105210).

Further, Ishimaru and Takigawa, the inventors of the present invention, have proposed an air jet flow type apparatus for treating textile fabric having a reformed circular treating passageway, in which an exit section of the residence chamber having a reel or roll is in spherical and is in low position so as not to allow tension load to act on textile fabric, and the inlet portion of the transferring passageway is jointed in approximately vertical position to the exist section of the residence chamber ( Patent Application No. 7-218434). Nomura, one of the inventors of the present invention, has proposed an air and liquor united type nozzle structure (Patent Application No.7-185331). Ishimaru, Takigawa and Nomura, the inventors of the present invention have derived a method which allows proper transfer and circulation of textile fabric, using a header of the apparatus with or without reel or roll, as the result upon improvement of an overall construction of the air jet flow type apparatus.

The present invention, as mentioned above, has solved the difficulties of the prior arts, and provides an apparatus and a method for treating textile materials adopting a new system composition with totally combination of arts so as to control properly cooling and drying operations during the treatment

DISCLOSURE OF INVENTION

It is an object of the present invention to provide an air jet flow type apparatus and method for treating textile fabric in rope form which allows fabric transfer by air jet flow and liquor jet flow from a treating fluid jetting section, without building in reel or roll in the header of the said apparatus, and which allows tensionless and smooth take-up of the fabric at a short distance from the exit section of the residence chamber which is located at a position lower than the entrance section of the said residence chamber.

It is another object of the present invention to provide an air jet flow type apparatus and a method for treating textile fabric in rope form at extreme low liquor ratio which do not allow not only tension load acting on fabric but also wrinkle of fabric, elongation of warp yarns, displacement of fabric meshes, and fabric friction and contact with other construction parts, and which is free from operation trouble such as results in entanglement of fabric.

It is further object of the present invention to provide an air jet flow type apparatus and method for treating textile fabric in rope form which allows the treatment of fabrics throughout a wide range of fabric weight from synthetic textile fabric of light weight per specific unit (METSUKE) up to textile fabric of heavy weight per specific unit and, furthermore, is provided with a nozzle device which ensures proper fabric propelling force by a treating liquid jetting section which allows adjustment of the mix ratio of liquor flow to air flow throughout wide application range of fabrics according to the type and weight per specific unit of fabric.

It is further object of the present invention to provide an air jet flow type apparatus and method which achieve energy-saving by cooling effect from the use of gasified latent heat, without using cooling water, in the cooling process and thereby save the required cooling time, prevent adhesion of oligomer to the treated fabric, and which enables a series of treatment up to drying.

According to the present invention, a circular fabric treating passageway comprising a transferring passageway and a residence chamber both of which are jointed to one another, wherein the transferring passageway which is provided with a treating fluid jetting section at its inlet portion bends and extends nearly straight from the bent portion and the outlet portion of the said transferring passageway is jointed in tongue form with the entrance section of the residence chamber. The exit section of the residence chamber is located lower than the entrance section of the chamber and is sloped toward fabric transfer direction so as to allow gradual fall-down of the fabric and the end of the said exit portion is in nearly spherical form and bends toward upward and jointed to the inlet portion of the transferring passageway.

A treating fluid jetting section which is installed on the inlet portion of the said transferring passageway is located at a lower height from ground level so that tension load acting on the fabric is minimized when the fabric is taken up in free condition from the residence chamber. Moreover, the residence chamber has a dual bottom provided with a porous perforated plate to facilitate dehydrating from the fabric and, in addition, the said residence chamber is provided with a liquor accumulating portion to store therein the separated water.

Textile fabric to be treated is sucked into the treating fluid jetting section which is located at low height as mentioned above and the fabric is transferred at a short distance from the residence chamber up to the transferring passageway, being then taken up and, where no reel or roll is equipped, frictional resistance to the fabric is reduced to the least so that the fabric is free from friction and contact with peripherals of the treating fluid jetting section. Moreover, even when the header is equipped with reel or roll, the fabric transfer direction can be smoothly converted toward the treating fluid jetting section, whereby smooth transfer of fabric is secured. The treating fluid jetting section comprises a liquor jetting portion and an air jetting portion, wherein air flow and liquor flow are jetted at the respective jet angles from the said air and liquor jetting portions, and jetting pressure adjustment of air flow and liquor flow and optimization of the fabric propelling force are attained by adjustment of clearance of the jet nozzles respectively. Thus, the method of the present invention allows proper adjustment of the treating fluid according to the purpose of treating, kind and weight per specific unit of the fabric to be treated.

The liquor jetting portion is connected to a treating liquor circulation conduit starting from the residence chamber bottom and reaching the liquor jetting portion via pump, heat exchanger and control valve and the air jetting portion is connected to an air circulation conduit starting from the gaseous phase area of the residence chamber and reaching the air jetting portion via blower and control valve. Therefore, the apparatus of the present invention is provided with a means which allows adjustment of the mixed fluid according to the kind of the fabric and weight per specific unit (METSUKE) of the fabric and which also allows adjustment of air to liquor mix ratio according to the purpose of treating. For example, air flow rate is increased for quick and smooth circulation of textile fabric in such a case where good relax effect and untwisting effect are required for synthetic fabrics of light weight per specific unit like polyester fabric. In such a case where short-time dyeing treatment and fibrilating treatment are required, a treating method which secures smooth transfer of fabric and does not allow uneven treating becomes available by controlling the liquor flow rate so as to increase.

Since the treating liquor contained in the treated fabric is dehydrated from the fabric by dropping and separating via a porous perforated plate which composes the dual bottom of the residence chamber, the water content in the treated fabric decreases and, as a result, the self-weight of fabric reduces correspondingly so that the fabric is transferred as if it was floating under the atmosphere of gaseous phase and, when the fabric is taken up by jetting force of the treating fluid jetting section which is located on the upstream end of the transferring passageway, the fabric can be transferred smoothly with its light weight, with almost no tension load acting on the fabric. The fabric can be taken up at short distance from the bottom of the treating chamber by the jetting force of the treating fluid jetting section and is free from warp directional elongation or rope wrinkle.

According to the present invention, where the residence chamber is not equipped with driving reel or roll at its exit section, the fabric is free from friction mark and contact mark which result from contact with reel or role and mesh displacement which results from frictional resistance. In such a case where the residence chamber is equipped with driving reel or roll at its exit section, fabric transfer direction is smoothly converted to the transferring passageway from the residence chamber so that the fabric is free from friction mark and contact mark. Furthermore, even at the outlet portion of the transferring passageway textile fabric can be fed smoothly into the residence chamber along the said passageway, whereby good feeling-treatment of the fabric can be carried out in tensionless condition.

The treating liquor separated in the residence chamber circulates through the treating liquor circulation conduit from the bottom of the residence chamber and the liquor accumulating portion of the chamber can smoothly circulate the liquor without surging phenomenon from the pump.

Textile fabric to be treated is first charged into the apparatus from a porthole which is provided at the exit section of the residence chamber and, thereafter, transferred the fabric from the transferring passageway into the residence chamber by means of air flow and subsequently circulated in loop form, after the butt ends of the fabric were seamed together into a loop form. Thereafter, dyeing and other necessary treatments are carried out with mixed fluid of air and liquor flow in the process wherein the temperature of the treating fluid which is jetted from the treating fluid jetting section is raised and retained at a constant degree. In the cooling process, then, the treated fabric is cooled down and further dried by gasified latent heat, after complete drain-out of high temperature liquor, while internal pressure of the apparatus is being gradually reduced for adjustment and pressuring-reducing operation is being repeated.

For the purpose of carrying out the sequential operation mentioned above, the apparatus is provided with high temperature liquor drain valve which is connected to the residence chamber, a pressure sensor to detect internal pressure of the air jet flow type treating apparatus, a pressure control valve for cooling control which is connected to the air jet flow type treating apparatus, and a control unit intended to control the said high temperature liquor drain valve and the pressure control valve according to control signals which are emitted from the said pressure sensor.

Since, in the cooling process, air only is jetted over textile fabric for thereby circulating the fabric without using liquor spray from the treating fluid jetting section and the fabric is cooled down by gasified latent heat which is attained from pressure control of the circulating air flow, then direct and efficient fabric cooling can be achieved without using cooling water. Furthermore, the present invention which is mainly treated the fabric by an air jet flow makes the treating liquor impregnated in textile fabric decrease and also makes heat value accumulated in the fabric the least so that the required cooling time can be shortened remarkably, with efficient cooling process by gasified latent heat which is attained by pressure control.

Moreover, the fabric can be dried easily by circulating and treating by air under a specific high pressure for a given time and thereafter rapidly deaerating up to normal pressure, before the fabric goes into the drying process, and circulating the fabric under the said pressure condition with drying air flow. Further, where fabric transfer by air flow only is made available, the drying method allows a drying process wherein the atmospheric air is sucked and exhausted, that is, allows consistent fabric treatment from charging the fabric up to dyeing and drying treatment.

BEST MODE OF CARRYING OUT THE INVENTION

Figure 1:
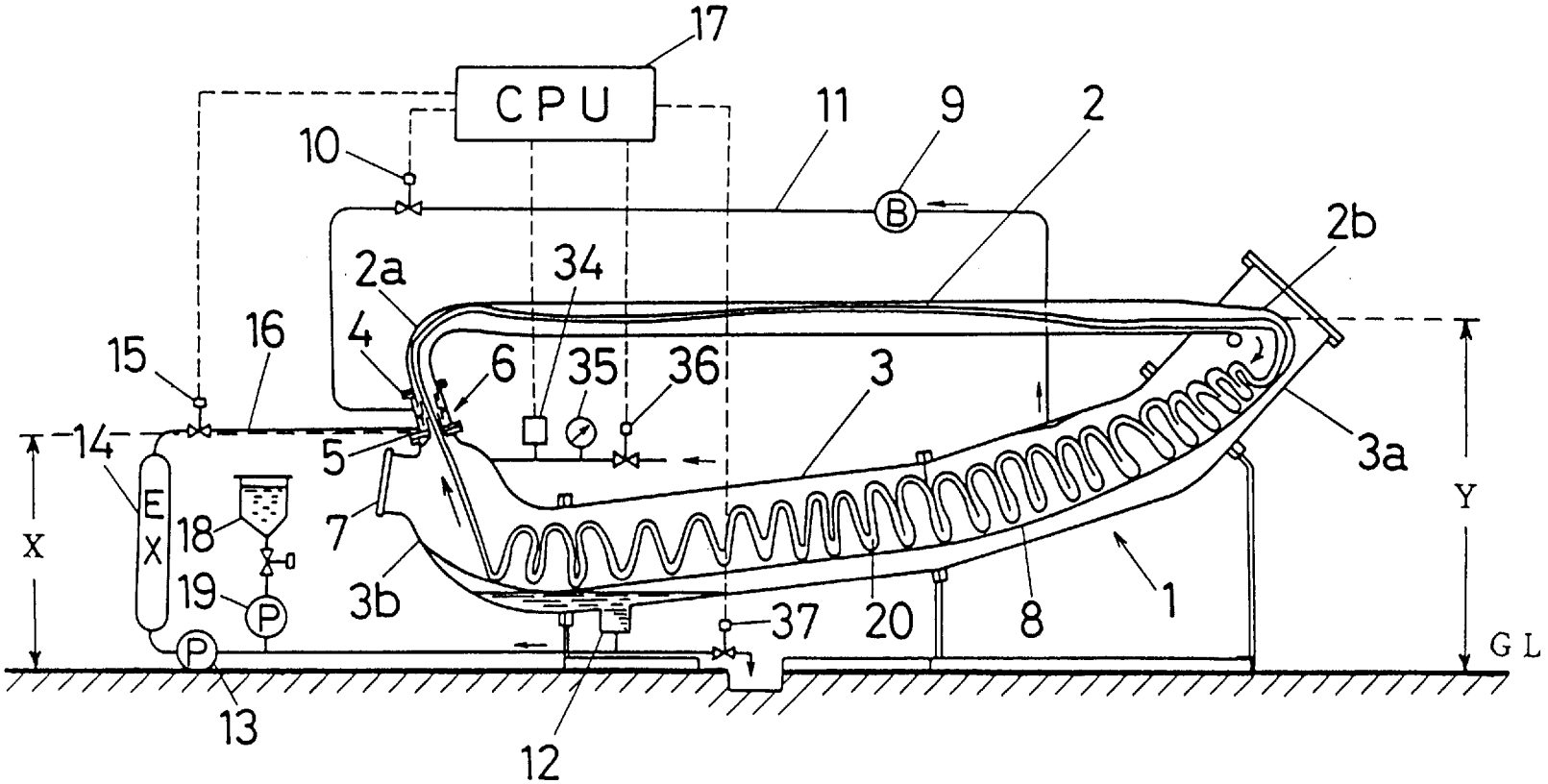
FIG. 1 is a cross-sectional view schematically illustrating an air jet flow type apparatus of the present invention.

The present invention is an air jet flow type apparatus and a method for treating textile fabric wherein textile fabric in rope form is charged into a circular fabric treating passageway which comprising a transferring passageway and a residence chamber both of which are jointed to one another at their ends and the charged fabric is seamed into an endless form, and is transferred from the transferring passageway to the residence chamber, and various treatments such as dyeing, scouring, bleaching, feeling-treatment, etc. are made to the fabric while transferring and circulating from the residence chamber to the transferring passageway and re-transferring the fabric by means of jetting force of air flow and liquor flow.

Fabric to be treated is transferred nearly straight in the transferring passageway and is advanced in zigzag form through the residence chamber. Since the treating liquor contained in the fabric dehydrated from the fabric by dropping-separation via a porous perforated plate which composes the dual bottom of the residence chamber, water content in the fabric decreases and, as a result, the self-weight of the fabric reduces correspondingly so that the fabric is transferred under gaseous phase as if it is floating in air and, when it is taken up by jetting force of the treating fluid jetting section which is located on upstream end of the transferring passageway, the fabric can be transferred smoothly due to its light weight, with nearly no tension load acting on the fabric.

Since the entrance section of the residence chamber is located at high position and the exit section of the chamber is located at low position on the ground on which the apparatus is installed, the fabric can be taken up at short distance by the treating fluid jetting section and is free from warp directional elongation, rope wrinkle, etc. In such a case where no driving reel or roll is equipped, the mesh displacement, friction mark, contact mark, etc. are effectively avoided due to no contact with the driving reel or roll.

The treating fluid jetting section comprises a nozzle of an air jetting portion which communicates with an air feed pipeline connected to an air circulation conduit and a nozzle of a liquor jetting portion which communicates with a liquor feed pipeline connected to a liquor circulation conduit, whereby air jet flow and liquor jet flow are jetted from each of the nozzles over textile fabric simultaneously after adjustment of the respective jets to a proper rate by changing the jetting angle on actual application. In jetting the treating fluid, each nozzle clearance is changed by shifting a central sliding tube and a tubular guide or a trumpet-shaped guide so as to allow proper adjustment of the fabric propelling force and the degree of fabric wetting as well as adjustment of air to liquor mix ratio according to the kind and weight of per specific unit of textile fabric and the purpose of treatment.

The present invention will now be explained in detail below, with reference to the accompanying drawings.

Figure 2:
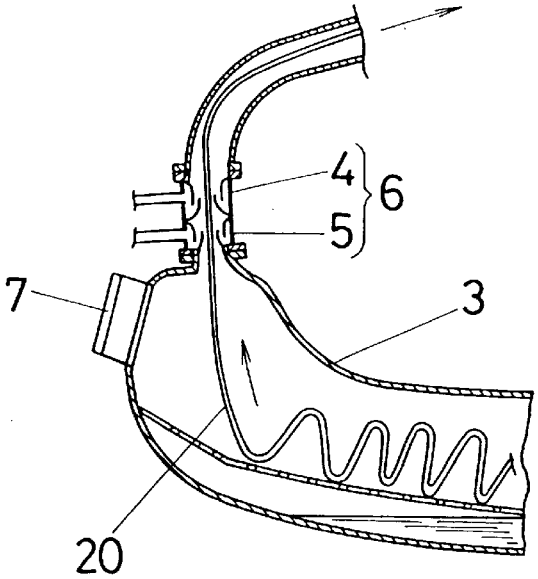
FIG. 2 is an enlarged cross-sectional view of main components of the apparatus.

FIG. 1 is a cross-sectional view schematically illustrating the air flow type apparatus of the present invention and FIG. 2 is an enlarged cross-sectional view of the main components of the apparatus. A circular fabric treating passageway 1 comprising a transferring passageway 2 and a residence chamber 3, both ends of which are jointed to one another. In detail, an inlet portion 2*a* of the transferring passageway 2 which is jointed with an exit section 3*b* of the residence chamber 3 via a treating fluid jetting section, in approximately vertical direction, and the passageway bends in direction of horizontal and further extends straight from its bent portion. The outlet portion 2*b* of the transferring passageway 2 is jointed in tongue joint type with an entrance section 3*a* of the residence chamber 3.

The residence chamber 3 is installed in gradual downward slope toward advancing direction of the fabric and its entrance section 3*a* is located at a position higher than its exit section 3*b* in spherical shape which is located at a low height close to the ground on which the apparatus is installed. In FIG. 1, X, Y and GL represent the height up to the exit section of the residence chamber, the height up to the entrance section of the residence chamber and the ground line (level) respectively, and the condition of both heights is X<Y. Air jetting portion 4 and liquor jetting portion 5 both of which compose a treating fluid jetting section 6. The treating fluid jetting section is installed in an inlet portion 2*a* of the transferring passageway 2 to allow mixing of air flow and liquor flow and jetting the mixed fluid over textile fabric. In FIG. 1, this treating fluid jetting section 6 is installed at only one place, but in some cases it may be installed at two or more portions of the transferring passageway to ensure smooth transfer and circulation of the textile fabric. A porthole for charging and taking-out the fabric which is installed at a low position close to the ground line and thereby charging and taking-out operation of the fabric is efficiently executed without using an auxiliary stepladder, etc.

The residence chamber 3 has a dual bottom with a porous perforated plate 8 so as to allow separation of the treating liquor which drips from the treated fabric. The apparatus is composed of an air circulating conduit 11 starting from the gaseous phase area of the residence chamber 3 and reaching the air jetting portion 4 via a blower 9 and a control valve 10. In this case, the air circulation conduit 11 does not use a heat exchanger. Liquor accumulating portion 12 is equipped under the bottom of the residence chamber. A circular conduit having a pump 13, a heat exchanger 14 and a control valve 15 is composed of a treating liquor circulation conduit 16 starting from the liquor accumulating portion 12 at the bottom of the residence chamber 3 and reaching the liquor jetting portion 5. The liquor accumulating portion 12 which is located at the bottom of the residence chamber acts to prevent surging phenomenon which may result from the pump 13.

The control valves 10 and 15 can control the mix ratio of air flow and liquor flow according to control signals from a controlling unit (CPU) 17, whereby fabric transfer at a constant speed is ensured with an effect by proper spray force which is adjustable according to the kind of a textile fabric to be treated and weight per specific unit of fabric to be treated. A treating liquor preparation tank 18 which is installed to feed dyestuff and auxiliary agent, from where the prepared treating liquor (dyestuff) is fed into the treating liquor circulation conduit 16 by a pump 19. 20 represents a textile fabric.

As mentioned above, a textile fabric 20 which is circulated through the circular fabric treating passageway 1 is taken up and sucked at a short distance by means of the fluid jetting force of air jet flow from the treating fluid jetting section 6 located at low height which is equipped between the exit section 3*b* of the residence chamber 3 and the inlet portion 2*a* of the transferring passageway 2. Therefore, textile fabric is free from contact mark which may arise from fabric contact with the edge of the treating fluid jetting section and also free from rope wrinkle and force wrinkle of fabric as well since the fabric is tensionlessly transferred. Thus, the present invention allows extreme low liquor ratio by air jet flow treatment and shortens the required treating time.

Figure 3:
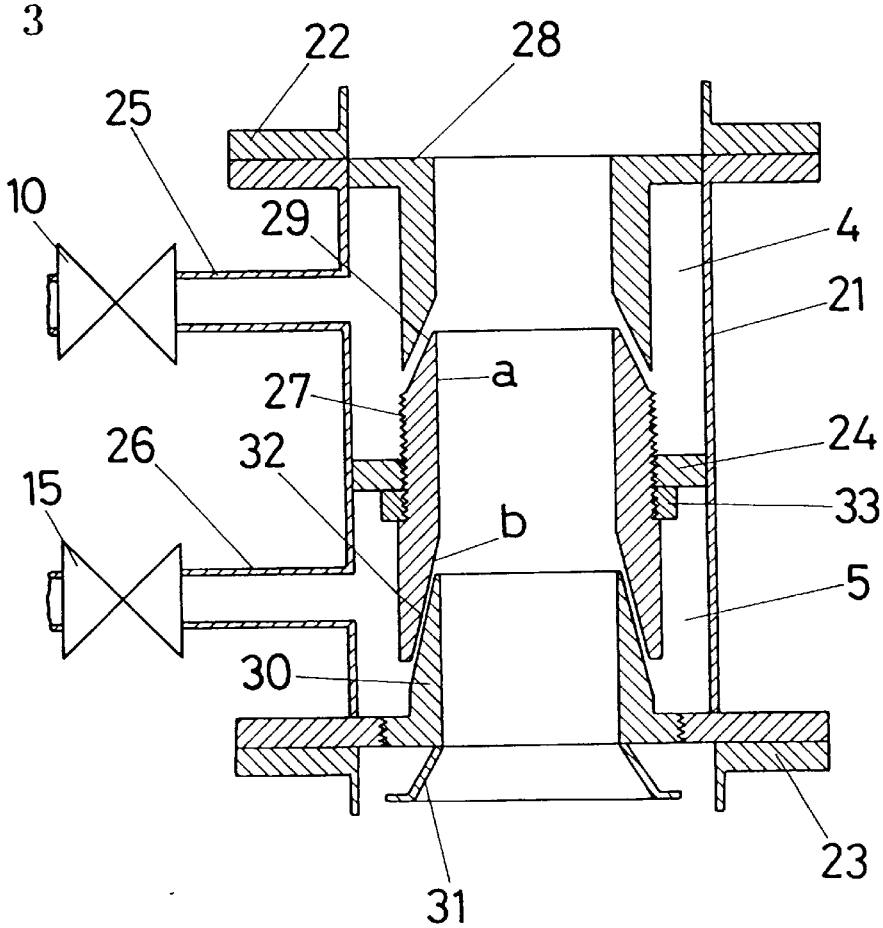
FIG. 3 is an enlarged cross-sectional view illustrating the nozzle device.

In FIG. 3, a nozzle case 21 as a treating fluid jetting portion is mounted on the inlet portion 2*a* of the transferring passageway 2 with flanges 22, 23, then composing a part of the fabric transferring passageway 2 of the circular fabric treating passageway. A partition flange 24 which is provided inside the nozzle case 21 at its center portion, whereby the nozzle case is internally divided into two spaces, which then compose the air jetting portion 4 and the liquor jetting portion 5.

An air feed pipeline 25 which is connected to the air circulation conduit 11 and is further communicated with the air jetting portion 4. A liquor feed pipeline 26 which is connected to the treating liquor circulation conduit 16 and is further communicated with the liquor jetting portion 5. A sliding tube 27 is inserted through the said partition flange 24 so as to slide freely.

In an example illustrated, a screw thread is used to ensure flexible sliding of the sliding tube, but not limited to this method since any arrangement is acceptable provided that the said tube can be securely fixed. The sliding tube 27 has a convexed ring-form taper surface(a) at its one end and a concaved ring-form taper surface (b) at its other end respectively. The convexed ring-form taper surface (a) is located within the liquor jetting portion 5 and the concaved ring-form taper surface (b) is located within the air jetting portion 4. A tubular guide 28 is fixed to flange 22 of the nozzle case 21 and is provided, at its inner end, with a convexed taper surface (a) which composes a nozzle (a) 29 corresponding to the taper surface (a) of the sliding tube 27

A trumpet-shaped guide 30 is mounted on the flange 23 of the nozzle case 21 so as to be available for sliding and is provided, at its one end, with convexed taper surface (b) corresponding to the taper surface (b) of the sliding tube 27, and is provided, at its another end, with a fabric guide portion 31. In an example illustrated, a screw thread is used as the method for sliding and fixing the guides, but not limited to this method provided that it is possible to fix the guides. The nozzle (b) 32 comprises the taper surface (b) of the sliding tube 27 and the taper surface (b) of the trumpet-shaped guide 30. An adjust ring 33 is fitted in the sliding tube 27 to regulate the fixed position of the sliding tube 27.

The spray angle of the taper surface (a) composing the nozzle (a) 29 is approximately 40 degrees in both directions from the center axis line of the sliding tube 27 and the spray angle of the taper surface (b) composing the nozzle (b) 32 is approximately 20 degrees in both directions from the center axis line of the sliding tube 27. The clearance range in the nozzle (a) is 2 to 15 mm and that in the nozzle (b) is adjustable in range of 0.4 to 2.0 mm, but the said clearance is further adjustable according to the required sliding strokes of the sliding tube 27 and the trumpet-shaped guide 30.

In FIG. 3, a trumpet-shaped guide 28 is mounted on the flange 22 so as to be available for sliding and the trumpet-shaped guide 30 is fixed to the flange 23. The clearance in the nozzle (a) and nozzle (b) is adjustable not only by sliding of the sliding tube 27 but also by sliding of the tubular guide 28. Furthermore, it is also possible to install the both tubular guide 28 and trumpet-shaped guide 30 so as to be available for sliding.

The construction and arrangement of the nozzle mentioned above allow opening-degree adjustment of the control valves 10 and 15 in accordance with command signals from the control unit 17, according to fabrics of different type and different weight per specific unit and application which requires fibrilation and untwisting effect as a purpose of treatment. Furthermore, adjustment of the fluid spray force by simultaneous adjustment of the nozzles (a) and (b) and by proper control of liquor to air mix ratio allows smooth transfer and sufficient circulation of textile fabric to be treated.

The air flow type apparatus of the present invention enables to reduce the required treating time and to thereby improve the treating productivity since textile fabric is transferred by jet flow action of air and liquor mixed fluid so that rope wrinkle is not fixed due to wrinkle spots which are variable all times and fabric transfer speed rate can be increased due to reduction of tension load acting on the textile fabric when it is taken up. Furthermore, the control unit 17 controls respective opening-degrees of the control valves 10, 15 to thereby regulate the fluid rate jetted from the air jetting section 4 and the liquor jetting section 5 and to thereby produce optimum air and liquor mixed fluid according to different fabric type and different fabric weight per specific unit, for example, depending on whether a fabric to be treated is polyester or wool. When relax effect and untwisting effect are required for treatment of polyester fabric, etc. depending on the purpose of treating, quick and smooth circulation of textile fabric can be achieved by increasing the air flow rate. Moreover, short-time dyeing and fibrilating treatment can also be effected by increasing the liquor flow rate.

In the present invention, the sliding tube equipped inside the nozzle case is so slidable as to allow change of the clearance in each of the nozzles which jet and feed air and treating liquor into each chamber from the air feed pipeline and the liquor feed pipeline, that is, enabling to select proper fabric propelling jet force according to the type and weight per specific unit of fabric. Sliding movement of the sliding tube via the flange which is provided inside the nozzle case allows individual or simultaneous change of the clearances in the nozzles (a) and (b) and allows sliding movement of the tubular guide and/or the trumpet-shaped guide. Moreover, the tubular guide is fixed to the nozzle case to facilitate installation of the said case and nozzle clearance adjustment can be made by sliding the sliding tube and trumpet-shaped guide. Further, the adjust ring holds the sliding tube constantly at its fixed position so as to allow easy adjustment of the nozzle clearance.

The nozzles (a) and (b) can set up and keep the respective clearance to a specific value all the times by control of the fixed position of the sliding tube to which the adjust ring is fitted, and thereby facilitate constant nozzle setting-up to the same type of textile. Furthermore, the jet spray angle of the air nozzle (a) ranges from 15 to 50 degrees in both directions from the center axis line of the sliding tube and the jet spray angle of the liquor nozzle ranges from 5 to 30 degrees in both direction from the center axis line of the sliding tube, whereby exact jet propelling force and exact wetting can both be given to textile fabric. Efficient jetting force can be attained by setting up the respective jet spray angles of the nozzles (a) and (b) to such a degree that the focal point of air jet flow from the nozzle (a) matches the focal point of liquor jet flow from the nozzle (b). The air jetting portion and liquor jetting portion are interchangeable in location so that optimum mixed fluid of air and liquor can be obtained according to textile fabric and smooth transfer and circulation of textile fabric can be achieved, which enables to significantly improve the quality of the treated textile fabric.

Figure 4:
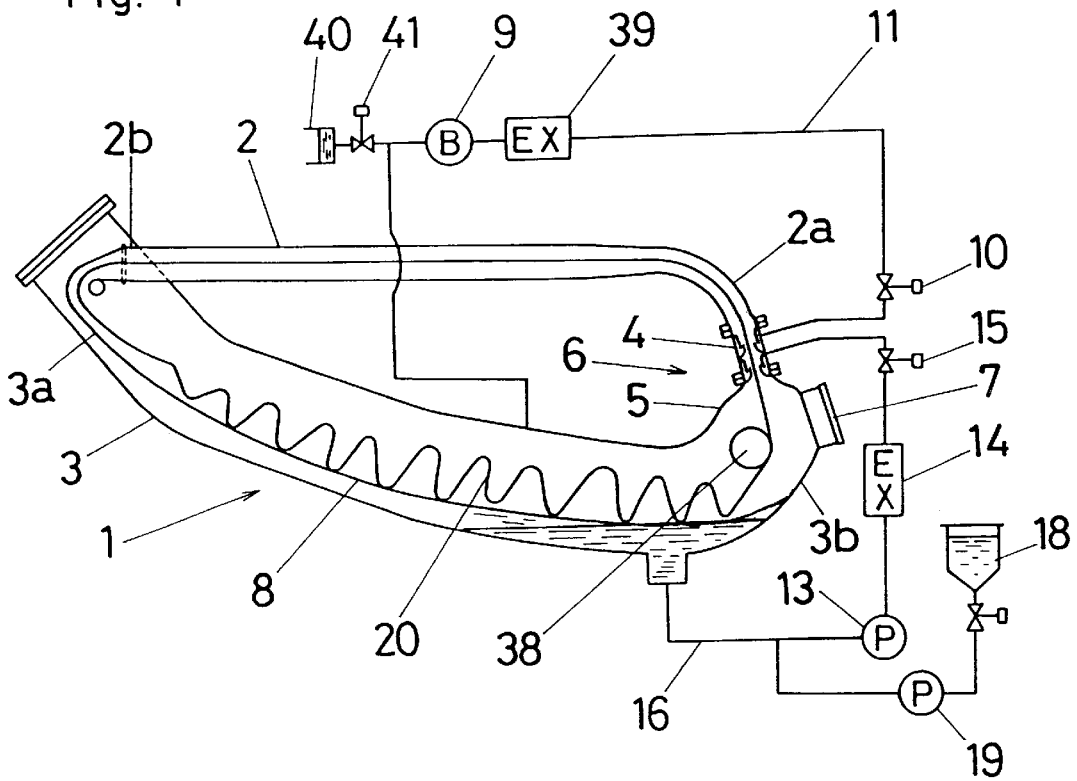
FIG. 4 is a cross-sectional view schematically illustrating another embodiment of the apparatus.

FIG. 4 is an another embodiment example of the air flow type apparatus of the present invention. A reel or roll 38 converts the advancing direction of a textile fabric 20 at the exit section 3*a* of the residence chamber 3 and thereby allows smooth sucking of the textile fabric into the treating fluid jetting section 6. A heat exchanger 39 is equipped on the air flow circulation conduit and a filter 40 acts as an air intake port. A valve 41 releases or shuts off intake of the air.

Figure 5:
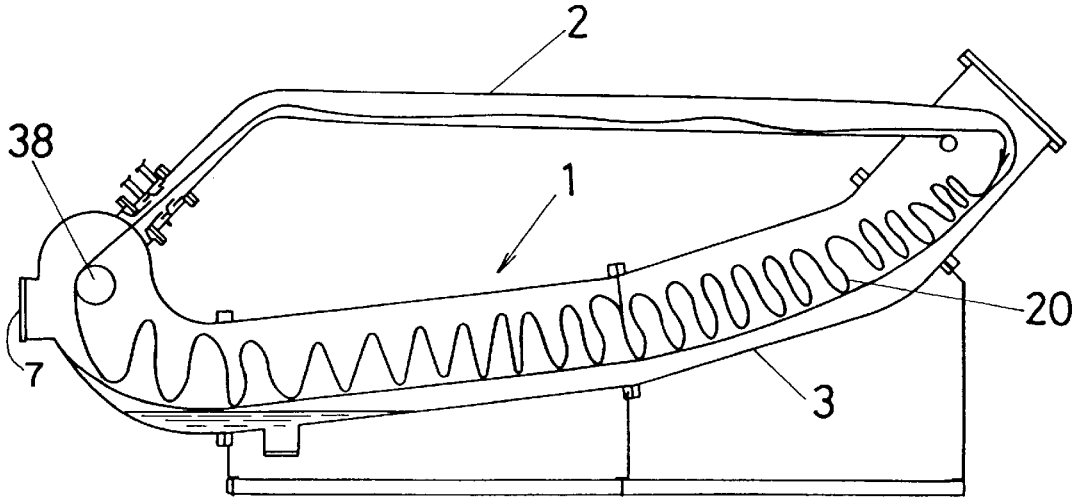
FIG. 5 is a cross-sectional view schematically illustrating a further embodiment of the apparatus.

FIG. 5 is a cross-sectional view schematically illustrating the main components of the other example of the present invention. A treating fluid jetting section which is installed at the inlet section of the transferring passageway 2 is inclined upward direction and consecutively, the transferring passageway extends in horizontal direction.

Figure 6:
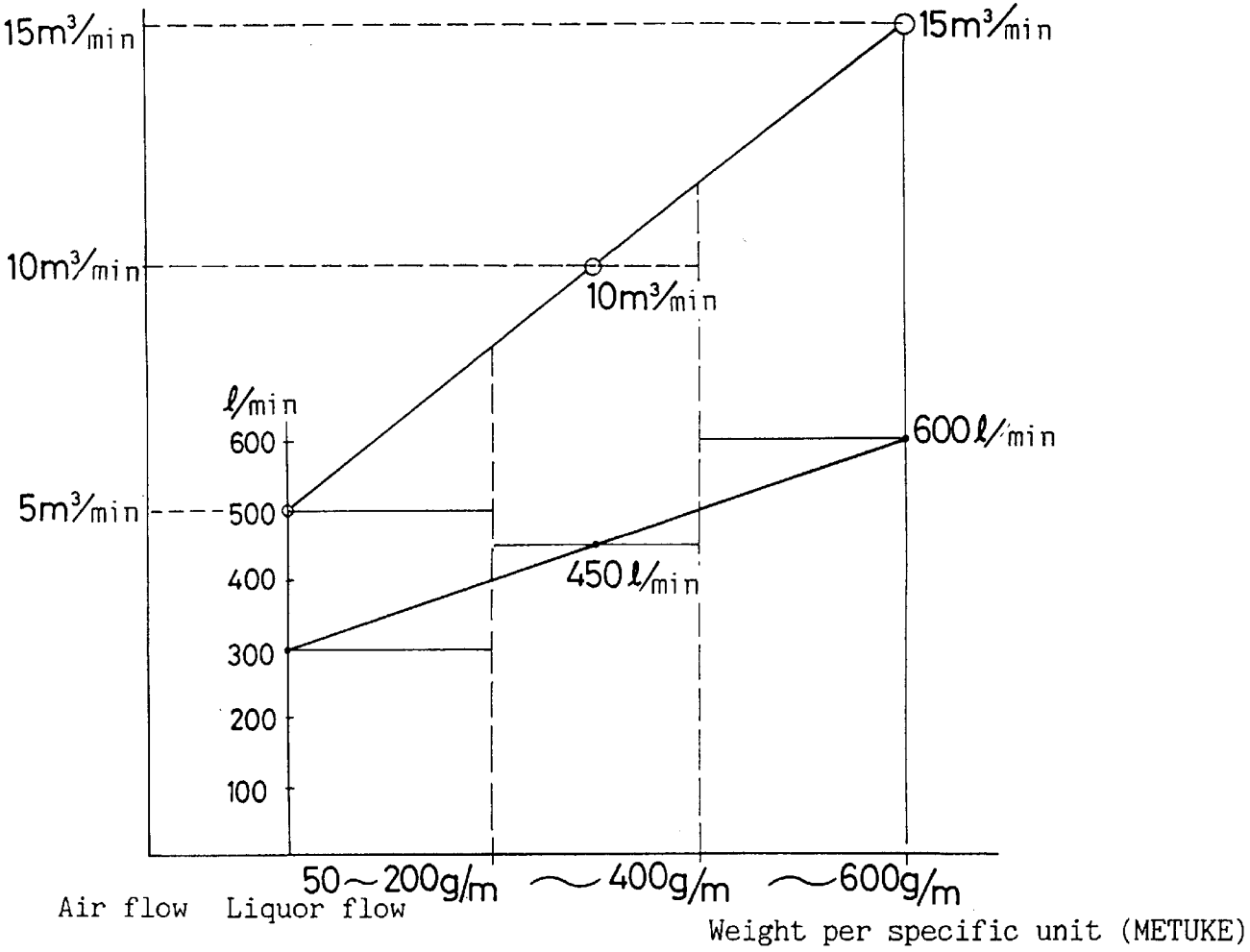
FIG. 6 is a graph showing the relationship between air-liquor mix discharge flow and fabric weight per specific unit.

FIG. 6 shows the discharge rate of air and liquor mixed fluid and the fabric weights per specific unit which correspond to each discharge rate of the mixed fluid. The vertical coordinate represents the air flow rate ranging from 5 to 15 cubic meters and pump discharge capacity ranging from 100 to 600 liters per minute, while the horizontal coordinate represents the range of fabric weights per specific unit which correspond to the said air flow rate and pump discharge, from which optimum discharge rate of the mixed fluid can be selected according to the purpose of fabric treatment.

The method of the present invention allows cooling down of textile fabric under treating by utilizing gasified latent heat which is obtained through pressure control of circulating air flow, without using cooling water in the cooling process.

That is as shown in FIG. 1, a pressure sensor 34, a pressure gauge 35 and a pressure control valve for cooling control 36 are connected to the exit section 3*b* of the residence chamber 3 respectively and the pressure data detected by the pressure sensor are inputted in the control unit 17, and open/close control of the pressure control valve 36 and the high temperature liquid drain valve 37 is effected according to commands from the control unit 17.

The control unit 17 stores in its memory the maximum reduction speed of the internal pressure of the apparatus during cooling operation and, upon comparing a detection result from the pressure sensor 34 with the stored optimum speed data, gradually reduces the pressure, for example, from 3 kg to 1 kg.

The high temperature liquid drain valve is kept closed and the control valves 10 and 15 are opened while textile fabric is being treated. High pressure air is fed into the apparatus through the pressure control valve 36, which closes when internal pressure of the apparatus has reached a specific pressure (ex. 3 kg/sq.cm ). Under this condition, a pump 13 starts to feed the treating liquor of high temperature into the treating fluid jetting section 6 which is located at the inlet section of the transferring passageway 2 and, thereafter, the treating liquor is jetted toward downstream section of the transferring passageway from the treating fluid jetting section. The blower 9 starts, at the same time, to feed the air, which was sucked from the upper section of the residence chamber 3, into the air jetting portion 4 through the air circulation conduit 11 and the air is jetted toward downstream section of the transferring passageway 2 from the air jetting portion 4.

Air and liquor mixed fluid is produced at the inlet section of the transferring passageway 2 by jet flow of air and liquor of high temperature from these air jetting portion 4 and liquor jetting portion 5 and, thereafter, the mixed fluid is jetted over a textile fabric 20, whereby the treating liquor is penetrated into the fabric 20. The fabric is further transferred through the transferring passageway 2 by action of air and liquor jet flow, then reaching the middle section of the residence chamber, through its entrance section, with sliding action of the textile fabric due to its self-weight, where the textile fabric stays in relax condition and, thereafter, is further gradually transferred in horizontal direction and pushed out of the middle section toward the exit section, being then taken up at the exit section by the treating fluid jetting section 6. On the other hand, excessive treating liquor separated from the treated fabric drips onto the bottom of the residence chamber 3 via the porous perforated plate 8 and is accumulated in a liquor accumulate portion 12, from where the excessive liquor is recovered in the treating liquor circulation conduit 16 and then fed again into the treating liquid jetting section 6 from the said circulation conduit 16.

Thus, the high temperature liquor drain valve is opened to drain out the liquor of high temperature after circulation treatment of the textile fabric 20 for a given time with the treating liquor and air. After complete drain-out of the high temperature liquor, the cooling operation is started and, at the same time, the internal pressure of the apparatus is gradually reduced according to commands from the control unit 17. In detail, the high temperature liquor drain valve 37 is opened to a specific opening-degree to permit drain out of air (steam) from the apparatus and, at same time, the pressure control valve 36 is opened to a specific opening-degree to induce high pressure air into the apparatus and to thereby partly compensate internal pressure drop in the apparatus which arises from drain-out of the air from the apparatus, whereby the internal pressure of the apparatus is gradually reduced to allow rapid cooling of the treating liquor, by gasified latent heat, which is impregnated in the textile fabric.

The process for raising and holding the temperature of the treating fluid at a constant degree performs dyeing and other treatment with air and liquor mixed fluid or otherwise the liquor individual, while the cooling process cools down the treating liquor by gasified latent heat while gradually reducing the internal pressure of the apparatus, after draining out the high temperature liquor. It is therefore possible to cool down the treating liquor directly and efficiently without using the cooling water. Non-use of the cooling water contributes to energy saving because an energy for circulating the cooling water can be omitted.

By performing drain-out of high temperature liquor prior to cooling operation, not only the required cooling time can be saved but also the liquor can be drained, with its high temperature kept, together with dissolved impurities such as oligomer, etc., which has a good effect in preventing contamination of the apparatus internals, so called, contamination of the chamber and re-contamination of the textile fabric. In the above-mentioned embodiment example, it is also possible to cool down the treating liquor by reducing the internal pressure, without draining the liquor at high temperature prior to the cooling operation, and in addition the method can prevent re-adhesion of oligomer and can reduce heat value of the treated textile fabric though, in this case, it takes a little more time for cooling than the method of draining the liquor at high temperature prior to cooling operation.

The method of the present invention makes further continued drying of textile fabric available after wet treatment of the textile fabric. For example, the internal pressure of the residence chamber 3 is raised up to 3K and textile fabric is circulated through the said residence chamber at 120 degrees C. for approximately 5 minutes and, thereafter, the air is exhausted (up to approximately 2k) and the residence chamber is re-pressurized. This sequential operation is repeated.

Furthermore, by intaking fresh air by the blower 9 and heat exchanger 35 which are equipped on the air circulation conduit as illustrated in FIG. 4, the air can be induced into the conduit through a filter 36 and a valve 37 and the drying process can be achieved by circulating the textile fabric with air flow only and exhausting the air. In this case, adequate drying effect can be obtained by using the blower 9 having the capacity of approximately 37 kw.

INDUSTRIAL APPLICABILITY

According to the present invention, after charging the textile fabric into a circular fabric treating passageway, dyeing, scouring, bleaching, and other feeling-treatment, etc. are made to the fabric while it is being transferred and circulated from the transferring passageway to the residence chamber and reversely from the residence chamber to the transferring passageway by means of jetting flow of air and liquor mixed fluid which is jetted from the treating fluid jetting section. The circular fabric treating passageway is composed of a transferring passageway intended to transfer the textile fabric in rope form and a residence chamber intended to transfer the textile fabric in zigzag form, both ends of which are jointed one another. Since the height (X) up to the exit section of the residence chamber as the air flow type apparatus for treating textile fabric is lower than the entrance section height (Y) of the said chamber and is close to the ground line (GL), no tension load acts on the textile fabric when it is taken up and a porthole is located at low position so that the textile fabric can be charged into the apparatus easily, safely and conveniently from a standing position of the operator, without using additionally a stairs, a stepladder, etc.

Figure 7A:
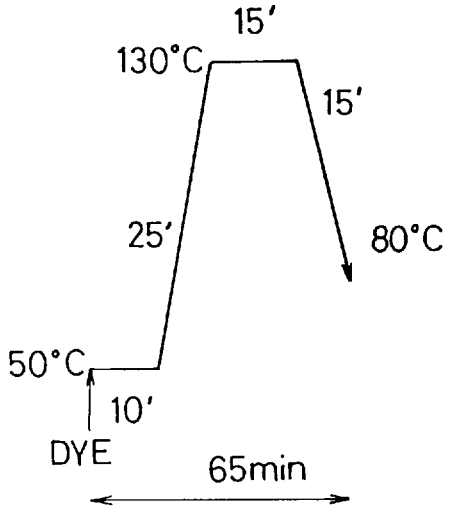
FIGS. 7*a* and 7*b* are a charts showing comparisons of dyeing treatment examples using polyester fabric.
Figure 7B:
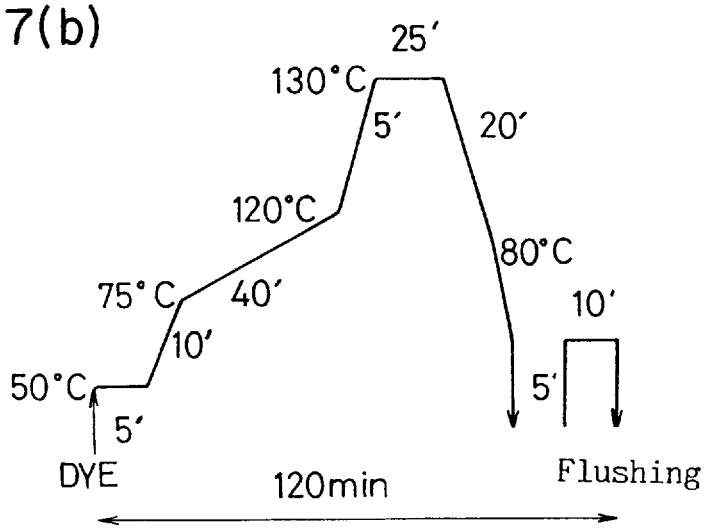
Figure 8:
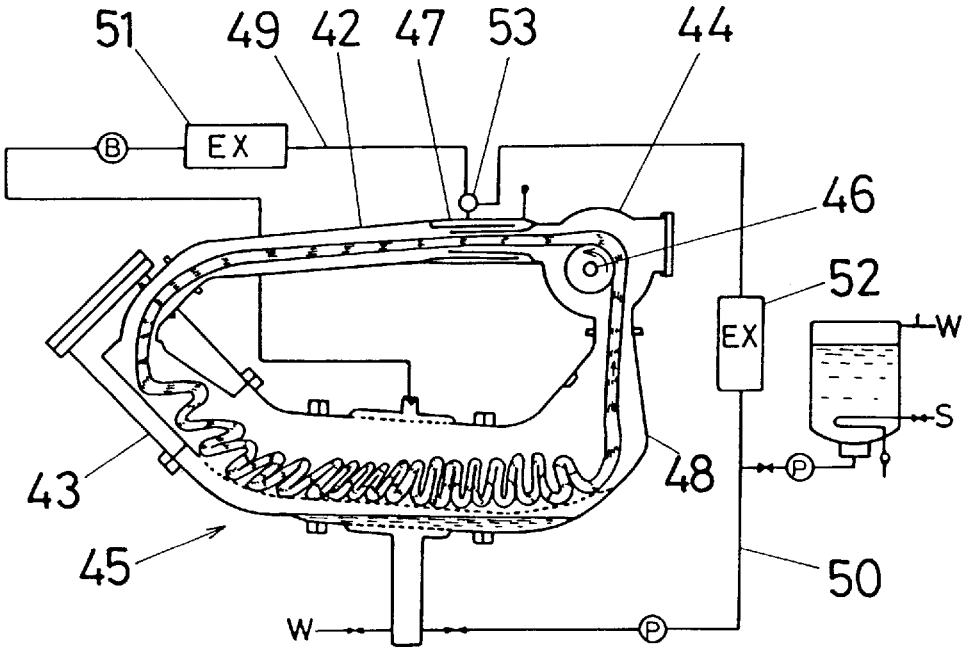
FIG. 8 is a cross-sectional view schematically illustrating the conventional example of air jet flow type apparatus.
Figure 9:
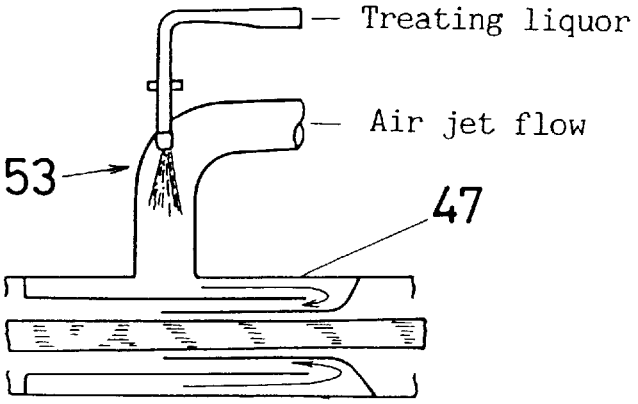
FIG. 9 is an enlarged cross-sectional view of the fluid mixing portion and nozzle device in the conventional apparatus.

Furthermore, in the treating fluid jetting section which is provided at the inlet section of the transferring passageway, the air to liquor mix ratio is adjustable suitably and the clearance of the nozzle is also automatically adjustable according to the type and weight per specific unit of textile fabric to be treated. In addition, the entire sequential operation of fabric charge, temperature raising, temperature holding at a constant degree, cooling down and drying can be carried out consistently at a short time. Particularly in the cooling process, a cooling system using gasified latent heat, instead of cooling water, can securely cool down the treated fabric in a short time. Therefore, the apparatus has feasibility of embodiments. The apparatus can properly treat textile fibers not only polyester and other synthetic fibers but also natural fibers such as cotton, wool, etc. by adjusting jet spray pressure of mixed fluid from the treating fluid jetting section according to the purpose of treatment. Referring to FIGS. 7(*a*) and 7(*b*), dyeing example of polyester fabric is compared herein below with dyeing by a conventional liquor flow dyeing machine.

(a) A dyeing recipe of the present invention

Polyester fiber knitted fabric: 500 m
120 kg(240 g/m)

Liquor volume: 350 liters

Fabric speed: 650 m/minute

Nozzle pressure: 5.0 kg/sq.cm

Flow rate: 350 liters/minute

Nozzles: 90–0.5 mm ( Liquor flow)
110–5 mm ( Air),
Air flow rate 8 cubic m/minute Steam consumption : 56 kg/batch Cooling water consumption: 0 liter/batch The full sequential operation from dyestuff charge up to cooling completed in 65 minutes, under the conditions mentioned above.

(b) A dyeing recipe by conventional liquor flow dyeing machine

Polyester fiber knitted fabric : 500 m
120 kg (240 g/m)

Liquor volume : 2000 liters

Fabric speed : 350 m/minute

Nozzle pressure : 2.0 kg/sq.cm

Flow rate : 1000 liters/minute

Nozzles : 80–5 mm ( Liquor flow)

Steam consumption : 160 kg/batch

Cooling water consumption: 2000 liter/batch

The full sequential operation from dyestuff charge up to cooling completed in 120 minutes, under the conditions mentioned above.

Therefore, comparing a) with b), the apparatus of the present invention could complete the full sequential operation in a short time equivalent to approximately half of the conventional dyeing machine, with success in energy saving under the low liquor ratio.

What is claimed is:

1. An air jet flow type apparatus for treating textile materials in rope form, comprising a fabric treating passageway in circular form which is composed of a transferring passageway intended to transfer the textile fabric in rope form (textile fabrics) and a residence chamber intended to transfer the textile fabric in zigzag form, both ends of which are jointed to one another, the transferring passageway is provided, at its inlet portion in approximately vertical position, with a treating fluid jetting section and the passageway bends in the direction of horizontal and extends in an approximately straight form, the residence chamber having a slope section which gradually inclines downward in direction from the entrance section of the chamber to the advancing direction of the textile fabric and having an exit section of spherical shape which bends upward and having a porous perforated plate which composes a dual bottom of the residence chamber, a treating liquor circulation conduit which feeds a treating liquor via a pump and a heat exchanger from a liquor accumulating portion being equipped at the bottom of the residence chamber, an air circulation conduit which feeds air from a gaseous phase area of the residence chamber through a blower, and carrying out dyeing and other treatment with jet flow of air and liquor mixed fluid jetted from the treating fluid jetting section while transferring and circulating the charged fabric from the transferring passageway to the residence chamber and re-transferring from the residence chamber to the transferring passageway, characterized in that air and liquor are jetted in combination from the treating fluid jetting section which comprises an air jetting portion and a liquor jetting portion, and the exit section of the residence chamber is located at a position lower than the entrance section of the chamber so that the textile fabric can be taken up from the exit section in direction to the treating fluid jetting section.

2. An air jet flow type apparatus for treating textile fabric in rope form according to claim 1, characterized in that the textile fabric is given an expanding action by a reel or a roll which is equipped in the exit section of the residence chamber, and the flow direction of the textile fabric is converted at small turning angle and, after turned, the textile fabric is transferred toward the axial direction of the treating fluid jetting section.

3. An air jet flow type apparatus for treating textile fabric in rope form according to claim 1, characterized in that the exit section of the residence chamber is located at a position lower than the entrance section thereof, close to the ground level, and is pherical, and the inlet portion of the transferring passageway which is jointed to the exit section of the residence chamber in approximately vertical position is provided with the treating fluid jetting section.

4. An air jet flow type apparatus for treating textile fabric in rope form according to claim 1, characterized in that the treating fluid jetting section comprises an air jetting portion and a liquor jetting portion each of which is equipped with a control valve to allow control of the feed rate and mix ratio of jet air and liquor by a control unit according to type and weight per specific unit of textile fabric and the purpose of treatment.

5. An air jet flow type apparatus for treating textile fabric in rope form according to claim 1, characterized in that the treating fluid jetting section comprises an air jetting portion and a liquor jetting portion each of which is equipped with a control valve so as to allow adjustment of air to liquor mix ratio as well as adjustment of nozzle clearance in the air jetting portion and the liquor jetting portion by the control unit, whereby the both jetting pressures are made variable.

6. An air jet flow type apparatus for treating textile fabric in rope form, comprising a fabric treating passageway in circular form which is composed of a transferring passageway intended to transfer the textile fabric in rope form and a residence chamber intended to transfer the textile fabric in zigzag form, both ends of which are jointed to one another, and carrying out dyeing and other treatment with jetting force of a treating mixed fluid which is composed of jet air flow and liquor flow jetted from the treating fluid jetting section while transferring and circulating the charged fabric from the transferring passageway to the residence chamber and re-transferring from the residence chamber to the transferring passageway, characterized in that a nozzle case is equipped via a flange so as to compose a part of the transferring passageway, the nozzle case is partitioned with a partition flange which is internally provided at the center point of the case, and is provided with an air feed pipeline which communicates with the air jetting portion and a liquor feed pipeline which communicates with the liquor jetting portion, a sliding tube having a convexed ring-form taper surface (a) at the end part of the air jetting portion and a concaved ring-form taper surface (b) at the end part of the liquor jetting section is provided so as to slide freely through the partition flange of the nozzle case, a tubular guide having a concaved ring-form taper surface (a) so as to form a nozzle (a) corresponding to the taper surface (a) of the sliding tube is provided at one end of the nozzle case, a trumpet-shaped guide having at its one end a convexed ring-form taper surface (b) so as to form a nozzle (b) corresponding to the taper surface (b) of the sliding tube and having its other end acting as a fabric guide is provided at other end of the nozzle case, and either one or both of the tubular guide and trumpet-shaped guide can slidable and the clearance in the nozzle (a) and nozzle (b) is adjustable respectively.

7. An air jet flow type apparatus for treating textile fabric in rope form according to claim 6, characterized in that the tubular guide is fixed to one end of the nozzle case, while the trumpet-shaped guide is screwed to other end of the nozzle case so that it can slide freely so as to allow adjustment of the clearance in the nozzle (a) and nozzle (b).

8. An air jet flow type apparatus for treating textile fabric in rope form according to claim 6, characterized in that an adjust ring is fitted on a screw threaded circumference of the sliding tube so as to slide freely and decides the sliding stop position of the sliding tube between itself and the partition flange provided at the internal center point of the nozzle case, whereby the clearance in the nozzles (a) and (b) is regulated.

9. An air jet flow type apparatus for treating textile fabric in rope form according to claim 6, characterized in that the jet spray angle of the nozzle (a) is 15 to 50 degrees in both directions from the axial center line of the sliding tube and the jet spray angle of the nozzle (b) is 5 to 30 degrees in both directions from the axial center line of the sliding tube.

10. An air jet flow type apparatus for treating textile fabric in rope form according to claim 6, characterized in that the jet spray angle is so set up that the focal point of air jet flow from the nozzle (a) matches that of liquor jet flow from the nozzle (b).

11. An air jet flow type apparatus for treating textile fabric in rope form according to claim 6, characterized in that the air jetting portion and liquor jetting portion provided inside the nozzle case are interchangeable with one another in their positions.

12. An air jet flow type apparatus for treating textile fabric in rope form, comprising a circular fabric treating passageway which is composed of a transferring passageway intended to transfer the textile fabric in rope form and a residence chamber intended to transfer the textile fabric in zigzag form, both ends of which are jointed to one another, the transferring passageway which is provided, at its inlet portion in approximately vertical position, with a treating fluid jetting section and the passageway bends in direction to horizontal position and extends in an approximately straight form, the residence chamber having a slope section which gradually inclines downward in direction from the entrance section of the chamber to the advancing direction of the textile fabric and having an exit section of spherical shape which bends upward and having a porous perforated plate which composes a dual bottom of the residence chamber, a treating liquor circulation conduit which feeds treating liquor via a pump and a heat exchanger from an liquid accumulating portion being equipped under the bottom of the residence chamber, an air circulation conduit which feeds air from a gaseous phase area of the residence chamber through a blower, and carrying out dyeing and other treatment with jetting force of air and liquor mixed fluid jetted from the treating fluid jetting section while transferring and circulating the charged fabric from the transferring passageway to the residence chamber and re-transferring from the residence chamber to the transferring passageway, characterized in that the apparatus is equipped with a high temperature liquid drain valve connected to the residence chamber, a pressure sensor intended to detect internal pressure of the apparatus, a pressure control valve for cooling control connected to the apparatus, and a control unit intended to control the high temperature liquid drain valve and pressure control valve for cooling control.

13. A method for treating a textile fabric in rope form in an air jet flow type, comprising charging the textile fabric in a circular fabric treating passageway comprised of a transferring passageway and a residence chamber both ends of which are jointed to one another, and carrying out dyeing and other treatment to the charged textile fabric while transferring the textile fabric from the transferring passageway to the residence chamber, but in zigzag form in the residence chamber, with jetting force of air and liquor mixed fluid which is jetted from the treating fluid jetting section having an air jetting portion and a liquor jetting portion and while re-circulating the fabric to the transferring passageway from the residence chamber with jetting force of the fluid, characterized in that the exit section of the residence chamber is located at a position lower than the entrance section thereof to thereby allow the treating liquor jetting portion at the inlet of the transferring passageway to locate at low position, the textile fabric is taken up at a short distance into the transferring passageway from the residence chamber with jetting force of the treating fluid which is jetted from the treating fluid jetting section and wetted with the treating liquor while being circulatingly transferred and, thereafter, the textile fabric moves down gradually in its advancing direction from the entrance section of the residence chamber, and dyeing and other treatment for feeling, etc. are applied to the textile fabric while being transferred in zigzag form as if floating, with separation of the treating liquor from the textile fabric by the dual bottom of the residence chamber, thereafter being again taken up in direction to the treating fluid jetting section for re-circulating.

14. A method for treating a textile fabric in rope form in an air jet flow type according to claim 13, comprising charging the textile fabric in a circular fabric treating passageway comprised of a transferring passageway and a residence chamber both ends of which are jointed to one another, and carrying out dyeing and other treatment to the charged textile fabric while transferring from the transferring passageway to the residence chamber, but in zigzag form in the residence chamber, with jetting force of air and liquor mixed fluid which is jetted from the treating fluid jetting section having an air jetting portion and a liquor jetting portion and while circulating again to the transferring passageway from the residence chamber with jetting force of the fluid, characterized in that dyeing and other treatment are effected with either air and liquor mixed fluid or the fluid of treating liquor individual in the process for raising and holding the treating fluid temperature at a constant degree and the treated textile fabric is cooled down in the cooling process by pressure control of the circulating air flow.

15. A method for treating a textile fabric in rope form in an air jet flow type according to claim 13, comprising charging the textile fabric in a circular fabric treating passageway comprised of a transferring passageway and a residence chamber both ends of which are jointed to one another, and carrying out dyeing and other treatment to the charged textile fabric while transferring from the transferring passageway to the residence chamber, but in zigzag form in the residence chamber, with jetting force of air and liquor mixed fluid which is jetted from the treating fluid jetting section having an air jetting portion and a liquor jetting portion and while circulating again to the transferring passageway from the residence chamber with jetting force of the fluid, characterized in that dyeing and other treatment are effected with either air and liquor mixed fluid or the fluid of treating liquor individual in the process for raising and holding the treating fluid temperature at a constant degree and, in the cooling process, cooling operation is effected with gasified latent heat while gradual pressure drop for adjustment, increase and reduction of the apparatus internal pressure are being repeated after drain-out of the high temperature liquor.

16. A method for treating a textile fabric in rope form in an air jet flow type according to claim 13, comprising charging the textile fabric in a circular fabric treating passageway comprised of a transferring passageway and a residence chamber both ends of which are jointed to one another, and carrying out dyeing and other treatment to the charged textile fabric while transferring from the transferring passageway to the residence chamber, but in zigzag form in the residence chamber, with jetting force of air and liquor mixed fluid which is jetted from the treating fluid jetting section having an air jetting portion and a liquor jetting portion and while circulating again to the transferring passageway from the residence chamber with jetting force of the fluid, characterized in that dyeing and other treatment are effected with either air and liquor mixed fluid or the fluid of treating liquor individual in the process for raising and holding the treating fluid temperature at a constant degree and, in the cooling process, the treated textile fabric is cooled down by gasified latent heat while the apparatus internal pressure is gradually adjusted for reduction after drain-out of the high temperature liquor and thereafter the treated textile fabric is dried by either circulating the air only or repeating air pressurizing and exhausting and, thereafter taken out the fabric from the apparatus.

* * * * *

UNITED STATES PATENT AND TRADEMARK OFFICE

CERTIFICATE OF CORRECTION

PATENT NO. : 5,850,651

DATED : December 22, 1998

INVENTOR(S) : ISHIMARU et al.

It is certified that error appears in the above-identified patent and that said Letters Patent is hereby corrected as shown below:

ON THE COVER PAGE

-- Related U.S. Application Data

[63] Continuation of application No. PCT/JP96/01985, Jul. 17, 1996 --

COLUMN 1, BEFORE THE FIRST LINE

Insert:
Cross Reference to Related Applications

-- This is a continuation of application No. PCT/JP96/01985, Jul. 17, 1996 which designated the U.S.--.

UNITED STATES PATENT AND TRADEMARK OFFICE

CERTIFICATE OF CORRECTION

PATENT NO. : 5,850,651

DATED : December 22, 1998

INVENTOR(S) : ISHIMARU et al.

It is certified that error appears in the above-identified patent and that said Letters Patent is hereby correcte as shown below:

ON THE COVER PAGE

Please add:

-- Related U.S. Application Data

[63] Continuation of application No. PCT/JP96/01985, Jul. 17, 1996 --.

Signed and Sealed this

Fourth Day of April, 2000

*Attest:*

*Attesting Officer*

Q. TODD DICKINSON

*Director of Patents and Trademarks*